US005330292A

United States Patent [19]

Sakanishi et al.

[11] Patent Number: 5,330,292

[45] Date of Patent: Jul. 19, 1994

[54] SYSTEM AND METHOD FOR TRANSMITTING AND CALCULATING DATA IN SHIELD MACHINE

[75] Inventors: Shoichi Sakanishi; Tetsuya Shinbo, both of Hiratsuka; Tomoyuki Abe, Fujisawa; Yasuhiko Ichimura, Hiratsuka; Yasuo Kanemitsu, Hiratsuka; Kanji Shibatani, Hiratsuka; Masahiko Yamamoto, Hiratsuka; Hiroaki Yamaguchi, Isehara, all of Japan

[73] Assignee: Kabushiki Kaisha Komatsu Seisakusho, Tokyo, Japan

[21] Appl. No.: 927,672

[22] PCT Filed: Mar. 8, 1991

[86] PCT No.: PCT/JP91/00316

§ 371 Date: Sep. 29, 1992

§ 102(e) Date: Sep. 29, 1992

[87] PCT Pub. No.: WO91/14077

PCT Pub. Date: Sep. 19, 1991

[30] Foreign Application Priority Data

Mar. 9, 1990 [JP] Japan ..... 2-58388

[51] Int. Cl.[5] ..... E21D 9/06

[52] U.S. Cl. ..... 405/141; 299/1.05; 405/138; 405/143; 342/135

[58] Field of Search ..... 405/141, 143, 146, 138, 405/184; 299/31, 32, 1.05, 1.1–1.9; 342/135

[56] References Cited

U.S. PATENT DOCUMENTS

| | | | |
|---|---|---|---|
| 3,315,258 | 4/1967 | Dillard . | |
| 3,683,380 | 8/1972 | Cantwell et al. | 342/135 X |
| 3,730,628 | 5/1973 | Wolcott et al. | 342/135 X |
| 3,738,749 | 6/1973 | Everast | 342/135 X |
| 4,083,047 | 4/1978 | Schalon | 342/135 X |
| 4,195,297 | 3/1980 | Conner | 342/335 |
| 4,311,411 | 1/1982 | Akesaka et al. | 405/143 X |
| 4,495,804 | 1/1985 | LeBlanc Smith et al. | 299/1.05 X |
| 4,708,395 | 11/1987 | Petry et al. | 299/1.05 X |
| 4,774,470 | 9/1988 | Takigawa et al. | 299/1.3 X |
| 4,851,852 | 9/1989 | Bjorke et al. | 342/135 |
| 5,017,045 | 5/1991 | Kiritani et al. | 405/143 |

FOREIGN PATENT DOCUMENTS

| | | |
|---|---|---|
| 58-181999 | 10/1983 | Japan . |
| 61-153012 | 9/1986 | Japan . |
| 62-50294 | 3/1987 | Japan . |
| 62-50999 | 3/1987 | Japan . |
| 1-180487 | 7/1989 | Japan . |
| 2-28586 | 1/1990 | Japan . |

OTHER PUBLICATIONS

Proceeding Laser Range Instrumentation by C. G. Lehr, et al. Smithsonian Astrophysical Observatory, Oct. 16–17, 1967.

Principles of Modern Radar by Van Nostrand Reinhold New York, 1987 pp. 550–552.

*Primary Examiner*—Dennis L. Taylor

*Attorney, Agent, or Firm*—Richards, Medlock & Andrews

[57] ABSTRACT

The present invention discloses a system and a method for transmitting data in a shield machine and for calculating the filling amount of a void by detecting the distance to the natural ground. The system and the method are capable of transmitting analogue signals or signals of relatively high frequencies with reliability, enabling an unskilled operator to accurately detect buried articles and accurately carry out the back-filling work. Therefore, an optical rotary joint (100) is disposed between a rotary cutter head (10) and a non-rotary shield body (2) to count time taken to detect the peak value of a reflected signal larger than a standard value or time taken to detect the zero cross position present prior to the peak value. In accordance with the counted time, the distance between the antenna and the natural ground is calculated and displayed. Then, the void volume is calculated in accordance with the distance so that a target value of the back-filling amount is set.

25 Claims, 13 Drawing Sheets

SYSTEM AND METHOD FOR TRANSMITTING AND CALCULATING DATA IN SHIELD MACHINE

FIELD OF THE INVENTION

The present invention relates to a system and a method for transmitting and calculating data in a civil engineering machine, and, more particularly, to improvements in a system and a method for transmitting data in a shield machine and for calculating a filling amount of a void generated outside by detecting the distance to the natural ground.

BACKGROUND ART

Hitherto, it has been known that an obstruction detecting device is fastened to a cutter head in the leading portion of a civil engineering machine such as a shield machine so as to transmit electromagnetic waves and to receive waves reflected from a buried article for the purpose of detecting it. Therefore, a transmission antenna and a receiving antenna are fastened to the rotary cutter head so as to transmit a detected signal to a non-rotary shield body disposed in the rear portion via a slip ring, the detected signal being then calculated by an attached computer. The results of the calculations are displayed so that the presence of the buried article is detected.

However, the fact that the impedance matching of high frequency cannot be established with the aforesaid conventional electric connection method which uses the slip ring disables a high frequency signal of hundreds MHz to be transmitted. Therefore, a conversion to a low frequency is made before the transmission is performed. However, the efficiency is unsatisfactory and the cost cannot be reduced. What is worse, the electric connection established by using the slip ring can easily be affected by noise generated at the contact or by external noise, causing a problem to arise in that it is difficult to transmit analogue signals or signals of relatively high frequencies with reliability.

As a means for making waveform information of an underground radar visible, there are a first method (A-scope image) wherein an oscilloscope is so arranged that the waveform is drawn while making the axis of abscissa stand for time (the depth) and the axis of ordinate stand for the intensity, and another method (B-scope image) so arranged that the intensity of the signal is modulated while making the axis of ordinate stand for time (the depth) and the axis of abscissa stand for the distance so that a dark and light two dimensional image is drawn. However, there is a problem in that an unskilled operator cannot detect the accurate position of the buried article because dark and light fringe patterns are drawn on the display device due to the fact that reflected signals from multiple underground portions superpose on one another.

Furthermore, the conventional civil engineering machine such as the shield machine necessitates a backfilling work to be performed in such a manner that a void generated due to the excavation is filled with quick hardening concrete or the like for the purpose of preventing settlement of the ground level. In order to prevent the rupture of the natural ground around the tail, the back-filling work is performed in such a manner that filling is performed simultaneously with or immediately after the shield driving has been performed while completely filling the tail void. In the aforesaid backfilling work, the filling pressure and the filling amount are factors to be controlled.

However, the fact that the back-filling work in the conventional shield method has been so arranged that the size of the void is not included in the factors to be controlled causes a risk that back-filling work cannot be correctly performed. For example, filling by an amount smaller than a specified amount can be performed due to stop of the front portion in a case where the filling supply source pressure is controlled. In a case where the filling amount is controlled, there is a fear that the road surface is torn off, or that excavation becomes difficult because the filling material reaches the working face, or that the road surface caves in if the filling material has not been filled into a proper position. What is worse, a discrimination cannot be made as to whether or not the filling material has reached the working face even if the filling material is in a quantity larger than a specified quantity because the back-filling amount is changed depending upon the drive force, the specific gravity of the soil, the cutting force of the cutter and the type of the soil which is being excavated. There arises another problem in that the excavation becomes difficult if the filling pressure is excessively high because the filling material reaches the working face.

Accordingly, an object of the present invention is to provide a system and a method for transmitting and calculating data in a shield machine capable of transmitting analog signals or signals having relatively high frequencies with reliability while eliminating an influence of noise, enabling an unskilled operator to know the accurate position of a buried article, and accurately perform void filling work.

SUMMARY OF THE INVENTION

According to a first aspect of the present invention, there is provided a shield machine arranged in such a manner that a transmitting/receiving antenna is disposed in the outer portion of the front surface of a rotary cutter head so as to detect the status of a forward natural ground and as well as display it on a display device of a shield body in the rear portion thereof, wherein an optical rotary joint to be connected to an optical fiber is disposed between the rotary cutter head and the non-rotary shield body or a laser signal oscillator for transmitting data between the rotary cutter head and the non-rotary shield body is disposed in either of the rotary cutter head or the non-rotary shield body.

According to the thus arranged structure, the high frequency signal can be transmitted while preventing the loss and impedance matching can be improved because the optical rotary joint and the optical fiber are used. Furthermore, the structure can be simplified because the diameter and the weight can be reduced and excellent flexibility can be realized. Furthermore, even if a laser is employed to transfer the signal, there arises a simple necessity of forming a small hole in the rotary portion of the cutter head or the stationary portion of the shield body. In a case where a multiplicity of signals are transmitted, it is necessary for an optical coupler or a divider to be provided for the rotary portion of the cutter head or the stationary portion of the shield body so as to realize the coupling and the division. Therefore, the structure can be simplified.

According to a second aspect of the present invention, there is provided a shield machine arranged in such a manner that electromagnetic waves are radiated from an antenna toward a natural ground and the status of the natural ground is detected by receiving reflected waves, comprising: detection means for detecting a peak value of the reflected signal larger than a predetermined standard value; time counting means for counting time taken from transmission of a signal to be broadcast until the detection of the peak value; calculating means for calculating the distance between the antenna and the natural ground in accordance with the counted time; and display means for displaying the distance, or comprising detection means for detecting the level value of the reflected signal larger than a predetermined standard value, zero cross detection means for detecting the zero cross position of the reflected signal; and time counting means for counting the time taken from the transmission of a signal to be broadcast to the detection of the zero cross position, so that the distance between the antenna and the natural ground is calculated and displayed in accordance with the counted time.

According to the thus arranged structure, only an intense reflected signal from a buried article or the like can be picked up and therefore the depth of the buried article can be clearly displayed because the peak value of the reflected signal larger than a predetermined standard value is detected, the time taken to detect the peak value is counted, and it is converted into the distance so as to be displayed. Furthermore, only the intense reflected signal from a buried article or the like can be picked up and therefore the depth of the buried article can be clearly displayed by detecting the level value of the reflected signal larger than a predetermined standard value, by detecting the zero cross position of the reflected signal so as to count the time taken to detect the zero cross position, and by converting it into distance so as to be displayed.

According to a third aspect of the present invention, there is provided a shield machine arranged in such a manner that a transmitting/receiving antenna is provided for a shield body thereof, electromagnetic waves are radiated from the transmitting/receiving antenna toward a natural ground and the status of the natural ground is detected by receiving reflected waves, the shield machine comprising: detection means for detecting the level value of a reflected signal larger than a predetermined standard value; zero cross detection means for detecting the zero cross position of the reflected signal; time counting means for counting time taken from transmission of a signal to be broadcast to the detection of the zero cross position; forward movement measuring means for measuring the distance of the forward movement of the shield body; calculating means for calculating the distance between the shield body and the natural ground in accordance with the counted time; calculating means for calculating a void volume to be back-filled in accordance with the distance between the shield body and the natural ground and the distance of the forward movement of the shield body; and display means for displaying the void volume. According to the thus arranged structure, the back-filling work can be accurately performed because the void volume to be back-filled is obtained in accordance with the distance between the shield body and the ground and the forward movement distance of the shield body, and the comparison with an actual backfilling amount or the like is included in the factors to be controlled.

According to a fourth aspect of the present invention, there is provided a shield machine further comprising setting means for setting a target value of the back-filling amount in accordance with the void volume to be back-filled, measuring means for measuring an actual filling amount and display means for displaying the target value of the back-filling amount and the actual filling amount.

According to the thus arranged structure, the back-filling work can be further accurately carried out because the target back-filling amount is determined while taking into consideration the driving force of the shield jack or the specific gravity or the like of the soil in addition to the void volume to be back-filled, and the comparison with an actual back-filling amount is included in the factors to be controlled.

BEST MODE FOR CARRYING OUT THE INVENTION

The best mode for carrying out a system and a method for transmitting and calculating data in a shield machine according to the present invention will now be described with reference to the drawings.

Figure 1:
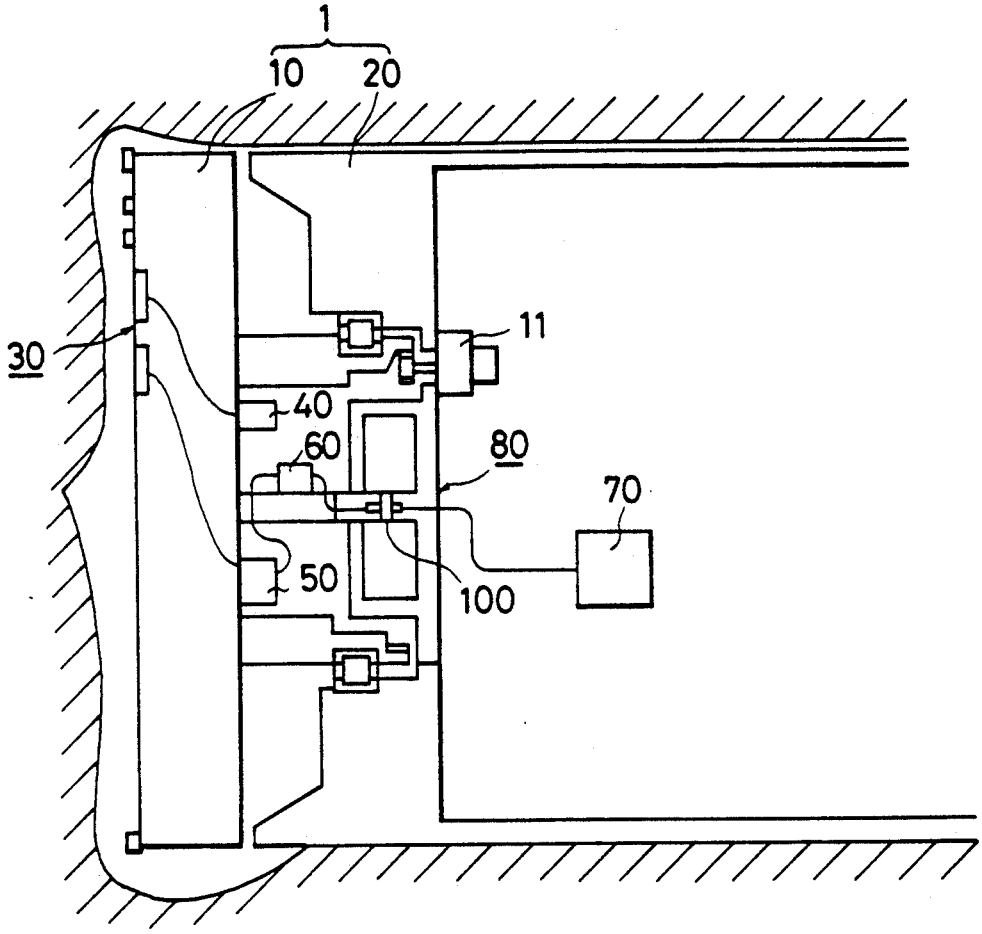
FIG. 1 is an overall structural view which illustrates a first embodiment of a system for transmitting data in a shield machine according to the present invention.
Figure 2:
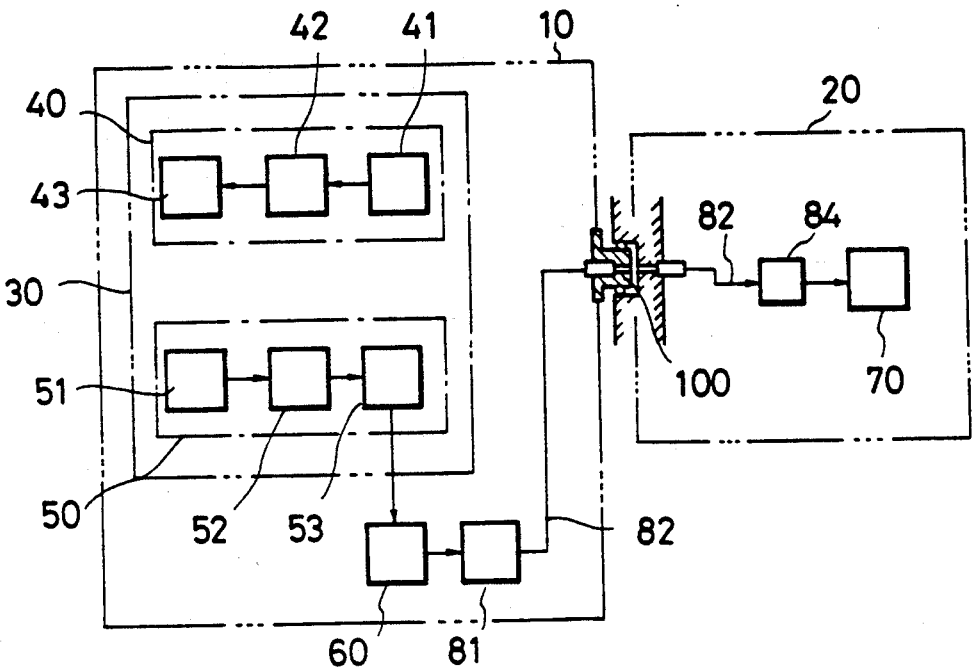
FIG. 2 is an enlarged cross sectional view which illustrates the data transmitting system shown in FIG. 1.

FIG. 1 is an overall structural view which illustrates a first embodiment of a system for transmitting data in a shield machine according to the present invention. FIG. 2 is a block diagram which illustrates a system for transmitting data. A shield machine 1 rotates a cutter head 10 by a motor 11 so as to excavate sediment, or a rock-bed, or the like. A shield body 20 which is not rotated but which is moved forwardly is disposed on the back of the cutter head 10. The cutter head 10 has a survey device 30 for supervising the rupture of the front natural ground and a control device 60 for controlling the survey device 30. The survey device 30 is constituted by a transmission device 40 and a receiving device 50. The shield body 20 has a display device 70, and transference between the control device 60 and the display device 70 is performed by using a transferring device 80. The transferring device 80 is constituted by an electricity-to-light converter 81, an optical fiber 82, an optical rotary joint 100 and a light-to-electricity converter 84.

The transmission device 40 is constituted by a trigger generator 41 for transmitting trigger signals for giving the timing at which electric waves are transmitted, a pulse generator 42 for generating pulse signals in accordance with the trigger signals, and a transmitting antenna 43 for transmitting electromagnetic waves in accordance with the generated pulse signals. An echo wave reflected from an underground buried article (omitted from illustration) is received by the receiving device 50. The receiving device 50 is constituted by a receiving antenna 51 for receiving the echo wave, a receiver 52 for converting the received echo wave into voltage, and an A/D converter 53 for converting it into a digital signal. The digital signal is calculated by a control device 60 comprising a microcomputer and the like. A signal transmitted from the control device 60 is converted into an optical signal by the electricity-to-light converter 81 before it is transferred to the light-to-electricity converter 84 via the optical fiber 82 and the optical rotary joint 100. It is converted into an electric signal by the light-to-electricity converter 84 so as to be displayed on the display device 70 such as a TV monitor.

Figure 3:
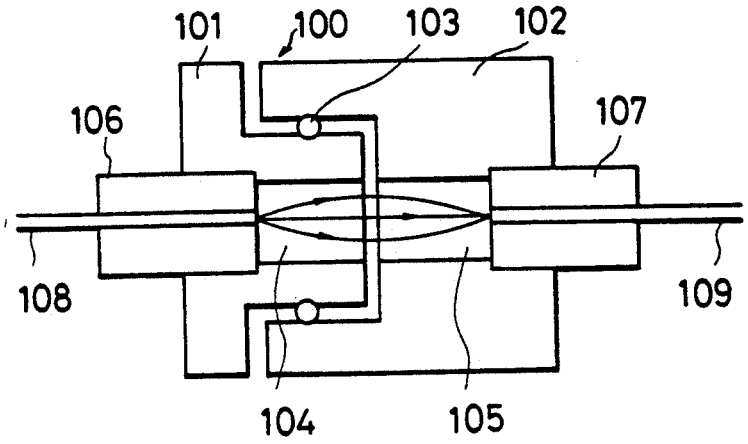
FIG. 3 is an enlarged cross sectional view which illustrates the optical rotary joint shown in FIG. 2.

FIG. 3 illustrates an example of the optical rotary joint 100 which is constituted by a joint portion 101 fastened to the cutter head 10 and a joint portion 102 fastened to the shield body 20. The aforesaid joint portions 101 and 102 are rotatively joined by a ball bearing 103 and having an optical path, the optical axis of which is the rotational shaft of them. The optical path has two rod lenses 104 and 105 disposed therein. Furthermore, a pair of optical fiber connectors 106 and 107 are disposed on the side which opposes the surface on which the rod lenses 104 and 105 abut against each other, the fiber connectors 106 and 107 being disposed in such a manner that the optical axes of the two optical fibers 108 and 109 and the optical axes of the two rod lenses 104 and 105 coincide with each other.

Figure 4:
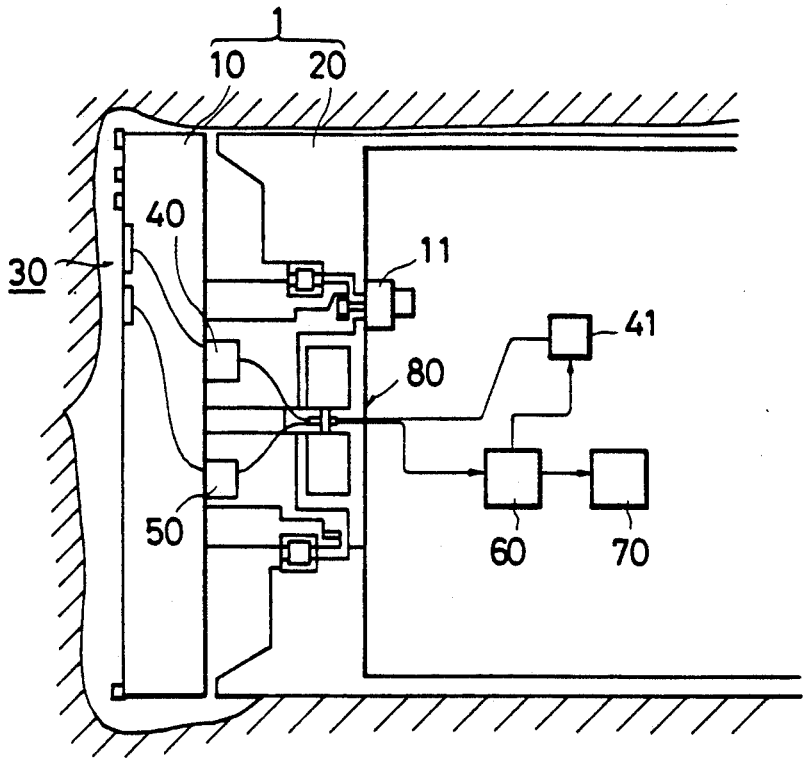
FIG. 4 is an overall structural view which illustrates an applicable example of the first embodiment.
Figure 5:
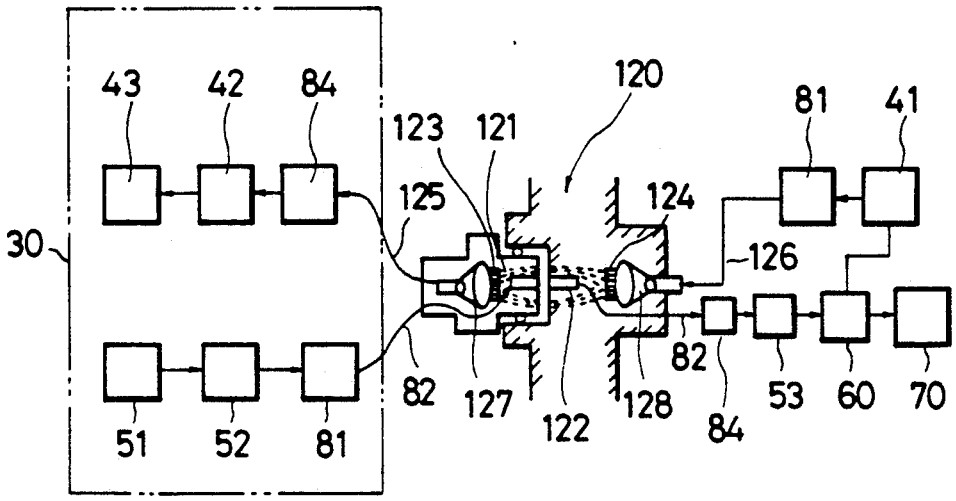
FIG. 5 is a block diagram which illustrates the data transmitting system shown in FIG. 4.

FIG. 4 is an overall structural view which illustrates an applicable example of the first embodiment. FIG. 5 is a block diagram which illustrates the system for transmitting data shown in FIG. 4. The shield body 20 has the control device 60 and the display device 70. A transferring device 80 is disposed between the trigger generator 41 and the pulse generator 42 and between the receiver 52 and the A/D converter 53, the transferring device 80 being constituted by the electricity-to-light converter 81, the optical fiber 82, an optical rotary joint 120 and the light-to-electricity converter 84. The optical rotary joint 120 is composed of a first channel 121 and a second channel 122. The first channel 121 is interposed between the trigger generator 41 and the pulse generator 42 while being connected by a pair of bundle fibers 123 and 124. The second channel 122 is disposed between the receiver 52 and the A/D converter 53 while being connected by a single-core optical fiber 82. The bundle fibers 123 and 124 extend to an input/output port at which optical couplings with external single-core optical fibers 125 and 126 are established by input-/output optical couplings 127 and 128 such as lenses.

Although the aforesaid embodiment uses the bundle fiber, a multi-channel optical rotary connector which comprises a prism may be used.

According to this embodiment, the optical rotary joint is used to transfer light so that high frequency waves can be transferred with a reduced loss at a wide zone and the impedance matching can be improved. Furthermore, the structure can be simplified because the diameter and the weight can be reduced and excellent flexibility can be obtained.

Figure 6:
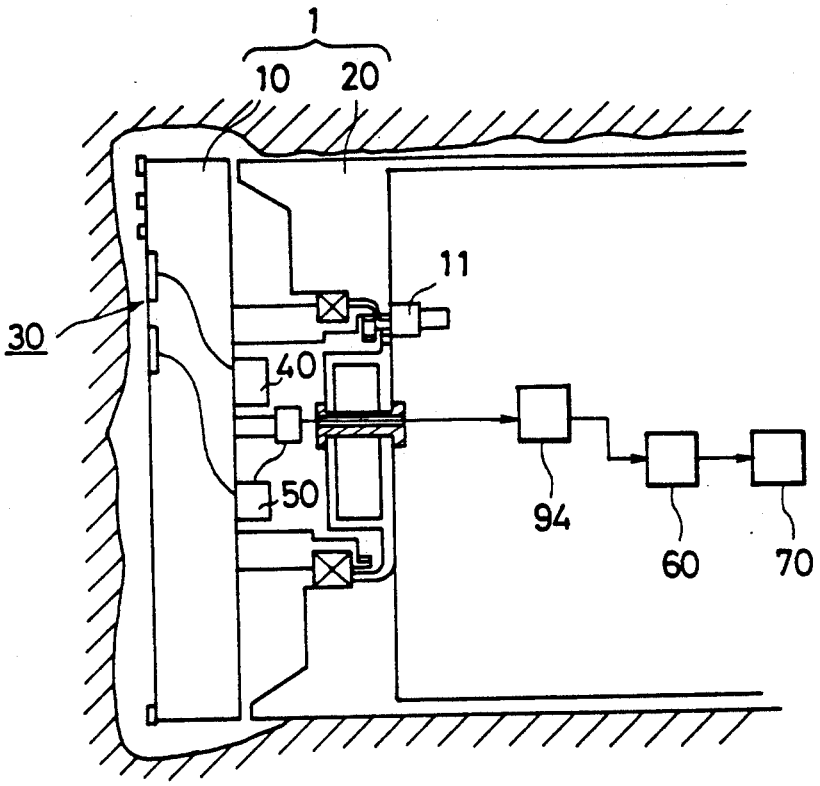
FIG. 6 is an overall structural view which illustrates a second embodiment of a system for transmitting data in a shield machine according to the present invention.
Figure 7:
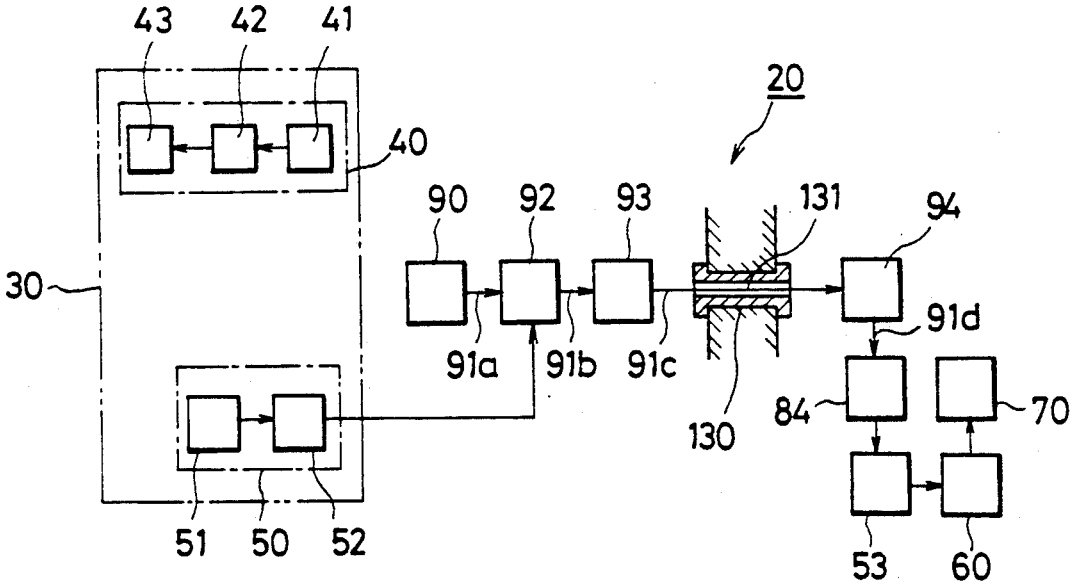
FIG. 7 is a block diagram which illustrates the data transmitting system shown in FIG. 6.

A second embodiment of a data transferring system according to the present invention will now be described in detail with reference to the drawings. FIG. 6 is an overall structural view which illustrates the data transferring system according to the second embodiment. FIG. 7 is a block diagram which illustrates the data transferring system shown in FIG. 6. The cutter head 10 has the surveying device 30, which is composed of the transmitting device 40 and the receiving device 50, and a laser oscillator 90. The shield body 20 has the control device 60 and the display device 70 disposed therein. A small hole 131 penetrates a junction portion 130 formed between the rotary portion of the cutter head 10 and the stationary portion of the shield body 20, the small hole 131 being a hole through which laser beams pass. The transmission device 40 is constituted by the trigger generator 41 for transmitting trigger signals for giving the timing at which electric waves are transmitted, the pulse generator 42 for generating pulse signals in accordance with the trigger signals, and a transmitting antenna 43 for transmitting electromagnetic waves in accordance with the generated pulse signals. A wave reflected from an underground buried article (omitted from illustration) is received by the receiving device 50. The receiving device 50 is constituted by the receiving antenna 51 and the receiver 52 for converting the thus received reflected wave into voltage. The voltage obtained by the receiver 52 is transmitted to a modulator 92 for modulating the phase of a laser beam 91*a* transmitted from the laser oscillator 90. A laser beam 91*b* transmitted from the modulator 92 passes, as a laser beam 91*c*, through the small hole 131 formed in the junction portion 130 via a transmission optical system 93 before it is received by a receiving optical system 94. A laser beam 91*d*, which has passed through the receiving optical system 94, is received by the light-to-electricity converter 84 so that it is converted into an electric signal. An electric signal transmitted from the light-to-electricity converter 84 is converted into a digital signal by the A/D converter 53. The signal converted into the digital signal is calculated by the control device 60 comprising a microcomputer so that the state of rupture of the natural ground is displayed on the display device 70 such as a TV monitor. Although the phase of the laser beam is modulated in the aforesaid embodiment, the amplitude may be modulated.

According to this embodiment, the laser beams are used as the signals to be transferred between the rotary portion of the cutter head 10 and the stationary portion of the shield body 20 so that the structure is simplified because there is a simple necessity of forming the small hole 131 in their junction portion 130.

A third embodiment of the present invention capable of detecting the accurate position of an underground buried article will now be described in detail with reference to FIGS. 8, 9 and 10.

Figure 8:
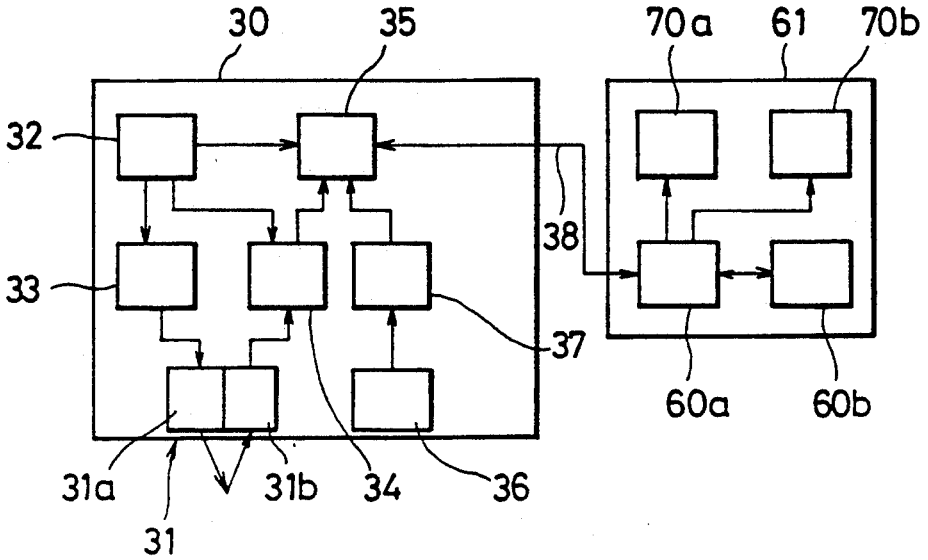
FIG. 8 is a block diagram which illustrates the circuit structure of a radar according to a third embodiment of the present invention.
Figure 9:
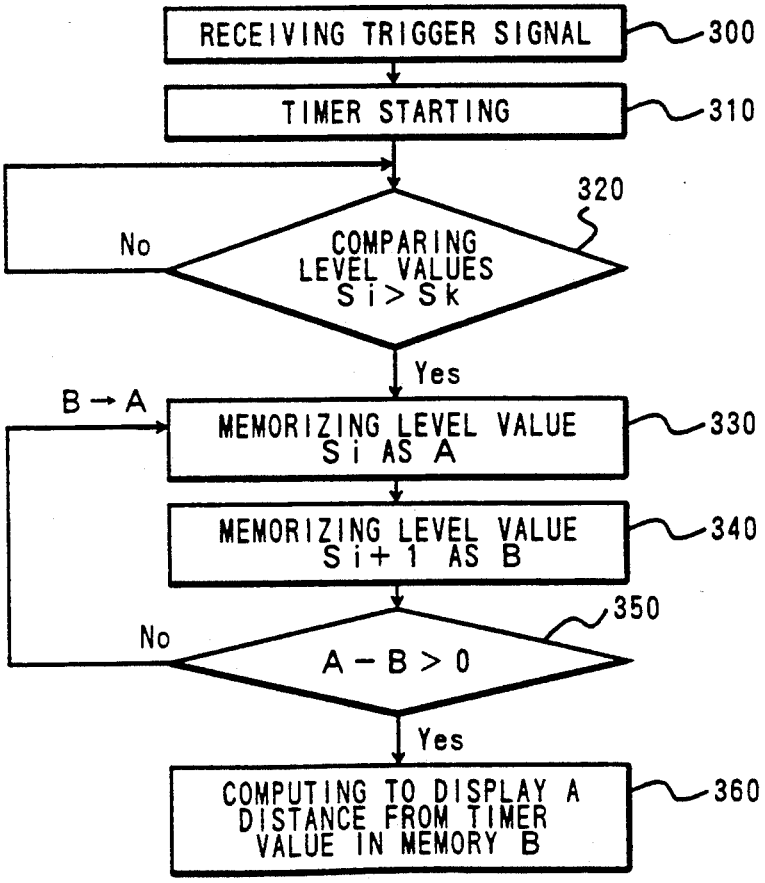
FIG. 9 is a flow chart which illustrates the operation of the circuit shown in FIG. 8.

Referring to FIG. 8, reference numeral 30 represents the surveying device and 61 represents a control and display device for controlling the surveying device 30. The aforesaid devices are connected to each other by a transferring cable 38 through which various information items and command signals are transferred. Reference numeral 31 represents an antenna mounted on a frame of the surveying device 30 and constituted by a pair of antennas composed of a transmitting antenna 31*a* and a receiving antenna 31*b*. The surveying device 30 includes a trigger circuit 32, a pulse generator 33, a sampler 34, a signal processing circuit 35, a travel sensor 36 and a position measuring device 37. Reference numeral 60*a* represents a computer connected to the signal processing circuit 35 by a transferring cable 38. The control and display device 61 is constituted by a storage device 60*b*, a CRT display device 70*a* for displaying the result of the detection and a printer 70*b* as well as the computer 60*a*.

In the thus arranged structure, the pulse signals generated by the trigger circuit 32 at a predetermined timing are controlled by the pulse generator 33 as to be a proper pulse oscillation frequency component and electric power before the pulse signals are transmitted to the transmitting antenna 31*a*. An electromagnetic wave transmitted from the transmitting antenna 31*a* is reflected by a medium boundary surface such as the natural ground or a buried article so that it is, as a reflected wave, received by the receiving antenna 31*b*.

Figure 10:
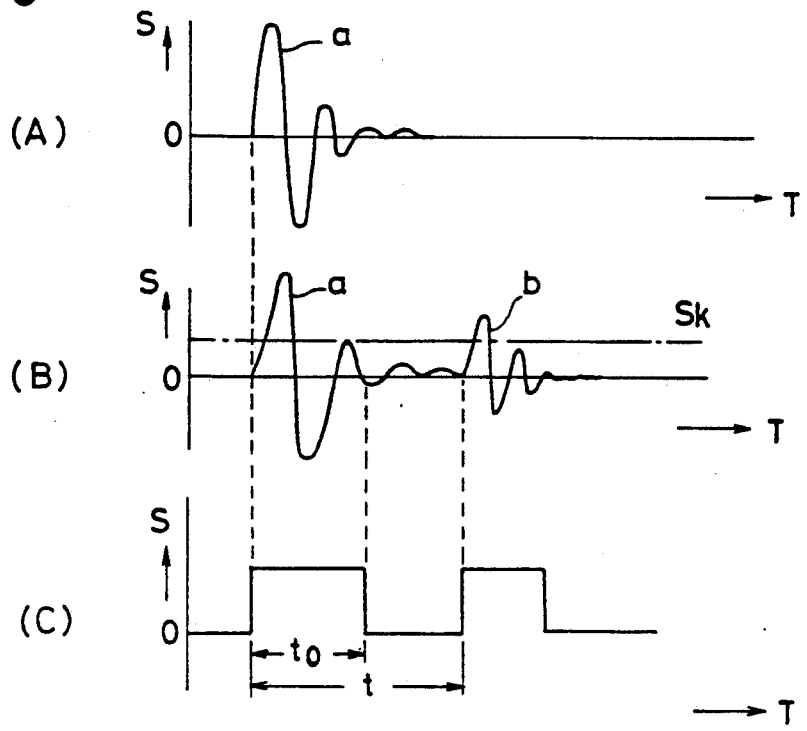
FIGS. 10 (A), (B) and (C) illustrate the relationship between the intensity of the reflected signal and the time.

FIG. 10 illustrates an example of a received waveform, where the axis of abscissa stands for time and the axis of ordinate stands for the magnitude of the receipt level. FIG. 10 (A) illustrates only direct wave a of the radiated electromagnetic wave. Therefore, if the direct wave a is included with reflected wave b as shown in FIG. 10 (B), the detection of the reflected wave b from the buried article becomes difficult. In order to eliminate the direct wave a, the received signal is masked from the trigger signal for a predetermined time t0 by the sampler 34 as shown in FIG. 10 (C). Furthermore, a signal transmitted from the trigger circuit 32 is used to improve the SN (signal to noise) ratio so as to shape it into a predetermined received waveform.

In the signal processing circuit 35, the signal is processed so as to be converted into a signal form which is adaptable to the transferring cable 38. Then, the trigger signal and position data are transferred to an interface circuit of the computer 60*a* via the transferring cable 38. The computer 60*a* calculates the status of the subject of the measurement from the time taken for the reflected wave to reach the receiving antenna 31*b* and from the intensity, and it transfers the result to the CRT display device 70*a* so as to be displayed. Calculated information is transferred to the storage device 60*b* and stored by it so that it is reproduced and utilized when it is required. Furthermore, calculated information can be printed out by the printer 70*b*.

Reference numeral 36 represents the travel sensor such as a rotary encoder fastened to a movable wheel of the surveying device 30 so as to measure the distance which the surveying device 30 has traveled. Reference numeral 37 represents the position measuring circuit for obtaining position information of the antenna by processing a signal transmitted from the travel sensor 36. Also position data obtained by the position measuring circuit 37 is transferred to the computer 60*a* from the inside of the signal processing circuit 35 via the cable 38.

Then, the operation to be performed in the control and display device 61 will now be described in detail with reference to a flow chart shown in FIG. 9. A trigger signal transmitted from the trigger circuit 32 is supplied to the pulse generator 33 so as to start the pulse generator 33, and it is transmitted from the interface circuit included by the signal processing circuit 35 via the cable 38 to the interface circuit included by the computer 60*a* so as to be read by the computer 60*a* (step 300). When the computer 60*a* has received the trigger signal, a timer function starts in step 310. The signal from receiving antenna 31*b* which is received by the computer 60*a* is a reflected signal which has been masked from the trigger signal for the predetermined time $t_0$ and therefore zero level has been continued. The level value S1 of the reflected signal is read and standard value Sk which has been stored in the storage device 60*b* is also read so as to be subjected to a comparison (step 320). If the level value S1 of the reflected signal is smaller than the standard value Sk, Step 320 is repeated in such a manner that next level value S2 is read until the level value Si of the reflected signal becomes larger than the standard value Sk.

When the level value Si of the reflected signal has become larger than the standard value Sk, the flow proceeds to step 330 in which the aforesaid level value Si is recorded as level A. The level Si indicates all of reflected signals ensuing the level Si of the aforesaid reflected signal and, from step 330, indicates the values detected in the aforesaid process. Also position information obtained by the position measuring device 37 at the same time as that of the reflected signal has been received is recorded.

In step 340, level value Si+1 of the next reflected signal is recorded as level B. Also position information obtained by the position measuring device 37 is recorded at this time.

In step 350, the contents of record A and those of record B are subjected to a comparison. If the contents of the record A are smaller than those of the record B, the flow returns to step 330 in which the contents of the record B are written to the record A. In step 340, level value Si+2 of the next reflected signal is recorded as level B similarly to the above made description, and the aforesaid operations are repeated until the contents of the record A become larger than those of the record B. When the contents of the record A have become larger than those of the record B, the timer value recorded at the level B is read from the aforesaid timer function, the timer value being converted into a value which denotes the distance from the antenna 31 to the buried article in accordance with an equation determined by the radar and the geological conditions. The thus obtained value is supplied to the CRT display device 70*a* so as to be displayed on its axis of ordinate. Also the position signal recorded simultaneously with the level B is supplied to the CRT display device 70*a* so as to be displayed on its axis of abscissa. Therefore, the image reflected from the buried article detected in accordance with the position of the surveying device 30 with the movement of the surveying device 30 is clearly displayed. The signal may be converted into an optical signal so as to be transferred between the surveying device 30 and the control and display portion 61 by an optical fiber. Furthermore, the surveying device 30 and the control and display portion 61 may be integrally formed. In addition, all of the operations may be performed by hardware composed of electronic components.

Although the above description is made about an arrangement in which the discrimination is made in accordance with a fact whether or not $A-B>0$, the same may be made in accordance with a fact whether or not $A-B\geqq 0$ or the like depending upon the shape and the size of the buried article. Furthermore, $A-B>0$ may be detected so as to display only information about the first peak value or the maximum peak value among a plurality of peak values may be detected so as to display only information about the buried article which reflects most intensely.

According to this embodiment, only the most intense reflected signal from the underground buried article is picked up and displayed. Therefore, its position can be accurately displayed and therefore the position at which the underground buried article is present can be detected by an unskilled operator.

Figure 11:
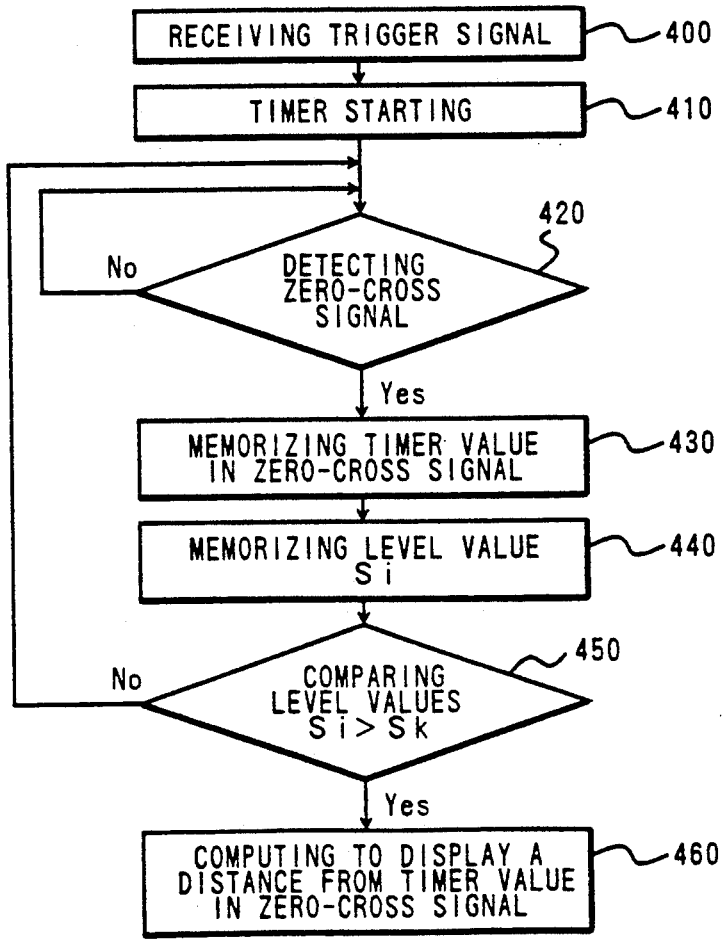
FIG. 11 is a flow chart which illustrates the operation of a fourth embodiment.

A fourth embodiment according to the present invention capable of accurately detecting the underground buried article will now be described in detail with reference mainly to a flow chart shown in FIG. 11. Incidentally, the structures are similar to those of the third embodiment shown in FIG. 8 and the same reference numerals are given while omitting their descriptions here.

First, an operator schematically surveys a prearranged region to be surveyed so as to set and record standard value Sk while observing the CRT display device 70*a*. Then, the trigger signal transmitted from the trigger circuit 32 is received by the computer 60*a* (step 400).

Then, the timer function starts in step 410.

The detected signal received by the computer 60*a* is the reflected signal b which has been masked for the predetermined time t0 and the zero signal has been continued as described with reference to FIG. 10. The computer 60*a* detects, as a zero cross signal, the value in the timer indicated when the received signal has been raised from the zero level in the period after the masked time $t_0$ (step 420). The zero cross detection function always checks the continuously supplied and received signals so as to reset the flow ensuing step 430, which has been performed, if there is a first transition signal which passes through the zero level and as well as restarts the flow ensuing step 430. Furthermore, it records, to the storage device 60*b*, the time value, which has been obtained when the signal has passed through the zero level, and position data supplied from the position measuring circuit 37 (step 430). In step 440, the level value Si of the received signal obtained after it has passed through the zero level is recorded to the storage device 60*b*.

In step 450, the computer 60*a* subjects the level value Si of the received signal and the standard value Sk to a comparison. If the level value Si is smaller than the standard value Sk, the flow returns to step 420 in which the level value of the next received signal is read, and the aforesaid operations are repeated until the level value Si becomes larger than the standard value Sk. If the zero cross signal is again detected before the level value Si becomes larger than the standard value Sk, the former operations in step 430 are reset. When the level value Si of the received signal becomes larger than the standard value Sk, the flow proceeds to step 460 in which the timer value indicated when the received signal has passed through the zero level and recorded in step 430. The read timer value is converted into a value denoting the distance to the buried article in accordance with the predetermined equation so as to be displayed on the axis of ordinate of the CRT display device 70*a*. Furthermore, position data recorded in step 430 is read so as to be displayed on the axis of abscissa as the position signal at the time of the detection of the zero cross. Therefore, the image reflected from the buried article detected in accordance with the position of the surveying device 30 with the movement of the surveying device 30 is clearly displayed. Incidentally, the standard value may be set in accordance with data processed to be adapted to the surveying conditions, and it may be recorded in the storage device 60*b*.

The aforesaid flow may be so arranged that the flow proceeds to step 460, the zero cross detection function is masked until the next trigger signal is received, and only the zero cross signal before the reflected signal which first exceeds the standard value after the trigger signal has been received is displayed. Alternatively, if a plurality of zero cross signals are present until the next trigger signal is received, all of them may be sequentially recorded and displayed.

In this embodiment, the zero cross position before the level value of the received and reflected signal which is larger than a predetermined standard value is detected, and the time component from the time at which the reflected signal has been transmitted to the time at which the zero cross position is detected is displayed as an image. Therefore, only an intense signal reflected from a buried article or the like can be picked up and displayed. Hence, an unskilled operator is able to accurately, easily and reliably detect the position at which the buried article or the like is present.

Figure 12:
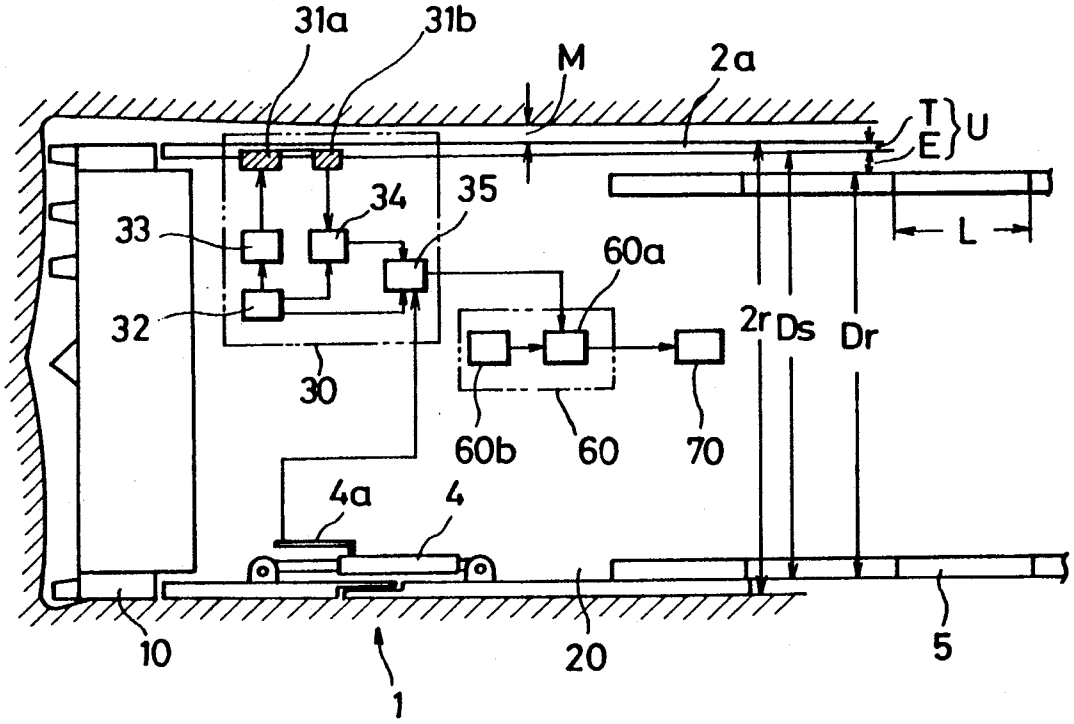
FIG. 12 is an overall structural view which illustrates a fifth embodiment of a system for calculating the void volume according to the present invention.
Figure 13:
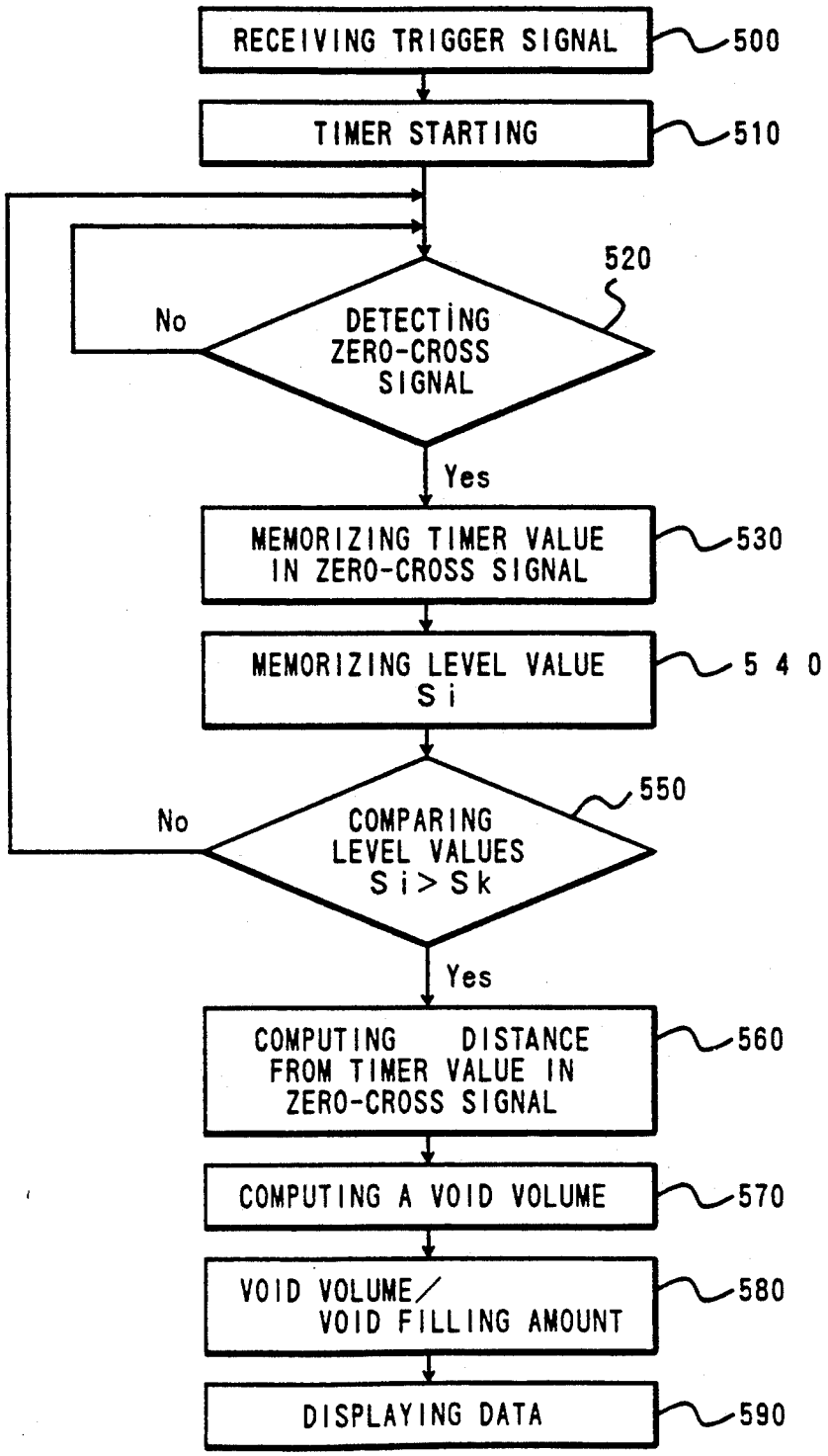
FIG. 13 is a flow chart which illustrates the operation of the system shown in FIG. 12.

A fifth embodiment of a system for calculating a void volume according to the present invention will now be described in detail with reference to the drawings. FIG. 12 is an overall structural view which illustrates a system for calculating a void volume. FIG. 13 is a flow chart which illustrates the operation of the system shown in FIG. 12.

Referring to FIG. 12, the cutter head 10 to be driven and rotated by a motor (omitted from illustration) is disposed in the front portion of the shield machine 1, the shield machine 1 being moving forwardly while excavating the natural ground by a pressing force of the shield jack 4. In the tail portion in the rear of the shield machine 1, a segment 5 is assembled so as to cause a tail void between the back side of the segment 5 and the natural ground to be filled with a back-filling material by the back-filling work. The tail void width U is a value obtained by adding tail clearance E and the thickness T of the skin plate 2*a*, the tail clearance E being the difference between the inner diameter Ds of a skin plate 2a of the shield machine 1 and the outer diameter Dr of the segment and required for performing the work. A shield tunnel is formed by repeating the assembly work of the segments 5. The skin plate 2a of the shield machine 1 has the antenna device 31. Furthermore, the body 20 of the shield machine 1 has the control device 60 and the display device 70. The surveying device 30 is constituted by the transmitting antenna 31a, the receiving antenna 31b, the trigger circuit 32 for emitting electromagnetic waves through the transmitting antenna 31a, the pulse generator 33, the sampler 34 for supplying received electromagnetic wave to the control device 60, and the signal processing circuit 35. The control device 60 is constituted by the storage device 60b comprising a ROM, a RAM, or the like, a calculating device 60a comprising a CPU or the like, and an interface and an input device which are omitted from illustration so as to calculate the distance between the natural ground and the shield body 20 or the back-filling amount. The back-filling amount calculated by the control device 60 is transferred to the display device 70 so as to be displayed. A position detector 4a is fastened to the shield jack 4 so that the distance of the travel of the skin plate 2a is detected, the detected distance being transferred to the control device 60 via the signal processing circuit 35. Incidentally, the shield machine 1 has a known hopper measuring device or a flow meter device (omitted from illustration) for measuring the back-filling amount so as to measure the back-filling amount Q.

In the thus arranged structure, the pulse signals generated by the trigger circuit 32 at a predetermined timing are controlled by the pulse generator 33 so as to have a predetermined pulse oscillation frequency component and electric power before they are transferred to the transmitting antenna 31a. The electromagnetic wave radiated from it is reflected by the medium boundary surface of the natural ground or the like so that it is, as the reflected wave, received by the receiving antenna 31b. The aforesaid reflected wave is processed as described with reference to FIG. 10. The signal processing circuit 35 performs a conversion to a signal adaptable to the functional characteristics of the transferring cable so as to transfer it to the control device 60. The control device 60 calculates the distance from the skin plate 2a to the natural ground in accordance with the time taken for the reflected wave to travel.

The operation of this embodiment will now be described with reference mainly to a flow chart shown in FIG. 13. The trigger signal transmitted from the trigger circuit 32 is supplied to the pulse generator 33 so as to start the pulse generator 33, and it is also transferred to the control device 60 via the signal processing circuit 35 so as to start the control device (step 500). In step 510, the timer circuit starts operation in response to the trigger signal transmitted from the trigger circuit 32. The signal to be received by the calculating device 60a is the reflected signal which has been masked from the trigger signal for the predetermined time t0 and after the zero signal has been continued. In step 520, the received signals which have been continuously supplied are always checked by the zero cross detection function so as to detect the first transition signal which has passed through the zero level. If the first transition signal has been detected, the timer value obtained when the received signal has passed through the zero level is recorded to the storage device 60b. In step 540, the received signal level Si is recorded to the storage device 60b. In step 550, a comparison is made between the standard value Sk, which has been previously determined in the storage device 60b, and Si. In a case where $Si-Sk<0$, the flow returns to step 520 in which the next received signal level is processed. In a case where $Si-Sk>0$, the distance (the void width) M from the natural ground to the outer surface of the skin plate 2a is calculated in step 560 so as to store the result in the storage device 60b.

Figure 14:
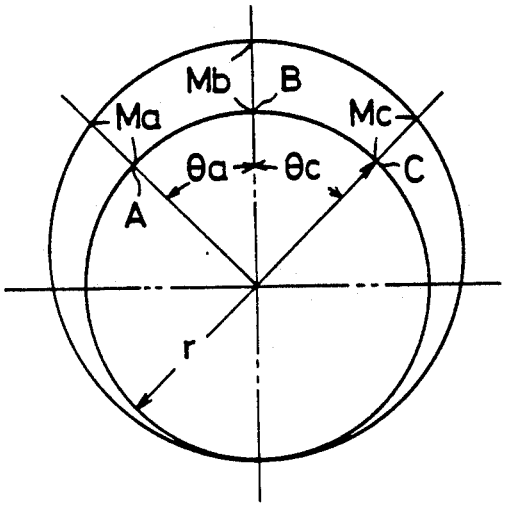
FIG. 14 illustrates the shield body according to the fifth embodiment and the dimensions of the natural ground.
Figure 15:
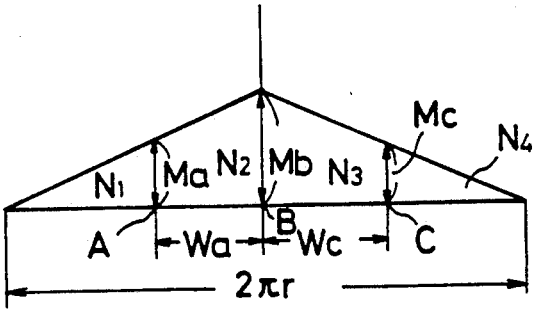
FIG. 15 is a developed view of FIG. 14.

In step 570, the thus measured distance is used to calculate the cross sectional area of the void. For example, distances Ma, Mb, Mc at the measuring points A, B and C shown in FIG. 14 are obtained, and then the void is developed and simplified as shown in FIG. 15. Thus, areas Ni, N2, N3 and N4 are obtained from the following equations:

$$\begin{aligned} N1 &= (\pi r - Wa)\cdot Ma/2 \\ &= (\pi - \Theta a)\cdot r\cdot Ma/2 \\ N2 &= (Ma + Mb)\cdot Wa/2 \\ &= (Ma + Mb)\cdot r\cdot \Theta a/2 \\ N3 &= (Mb + Mc)\cdot Wc/2 \\ &= (Mb + Mc)\cdot r\cdot \Theta c/2 \\ N4 &= (\pi r - Wc)\cdot Mc/2 \\ &= (\pi - \Theta c)\cdot r\cdot Mc/2 \end{aligned}$$

where $Wa=2\Theta a\cdot r$ $Wc=2\Theta c\cdot r$ $r=(Ds+2T)/2$ where r is the radius of the skin plate.

From the aforesaid equation, the cross sectional area Nv of the void is expressed as follows:

$$\begin{aligned} Nv &= \sum_{i=1}^{4} Ni \\ &= \{(Ma + Mc)\pi + Mb(\theta a + \theta c)\}r/2 \end{aligned}$$

Assuming that $\Theta a=\Theta c=p\cdot r$, the cross sectional area Nv of the void between the natural ground and the Skin plate 2a can be obtained from:

$$Nv=(Ma+Mc+2p\cdot Mb)r\pi/2$$

Then, the cross sectional area Nt of the tail void between the outer diameter 2 r of the skin plate 2a and the outer diameter Dr of the segment can be expressed as follows:

$$Nt=\pi(r^2-Dr^2/4)$$

Figure 16:
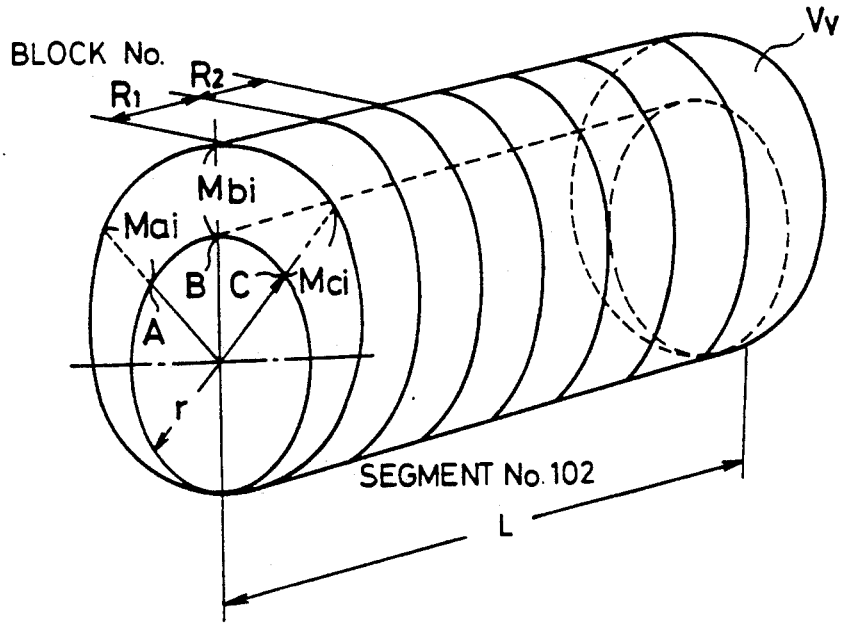
FIG. 16 illustrates a method for obtaining the void volume.

Then, the back-filling amount in a case where one segment (length L) has been obtained by obtaining the void volume Vv and the volume of the tail void Vt. Assuming that the number of data sampling per one segment (the length L) is 256 (see FIG. 16), the void volume Vv is expressed as follows:

$$\begin{aligned} Vv &= \int_0^L Nv(x)dx \\ &= (L/256) * \sum_{i=0}^{255} Nvi \end{aligned}$$

where $Nvi=(Mai+Mci+2p\cdot Mbi)\pi r/2$.

The volume Vt of the tail void is expressed as follows;

$$Vt = L \cdot \pi(r^2 - Dr^2/4)$$

Therefore, the total void volume V for one segment (the length L) can be expressed as follows:

$$\begin{aligned} V &= Vv + Vt \\ &= (L/256) * (r\pi/2) * \sum_{i=0}^{255} (Mai + Mci + 2p \cdot Mbi) + \\ &\quad L \cdot \pi(r^2 - Dr^2/4) \end{aligned}$$

In step 580, the ratio of the total void volume V and the actual back-filling quantity Q is obtained. When the ratio exceeds a predetermined numerical value, a measure such as issuing an alarm signal is, for example, taken. In step 590, the total void volume V and the actual backfilling amount Q are displayed on the display device 70.

Although the above description is made about the arrangement in which the filling work is conducted after a forward movement by one segment has been performed, filling may be carried out while further sectioning the forward movement. Furthermore, the cross section may be divided into four or more sections.

According to this embodiment, the back-filling work can be performed accurately because the distance between the natural ground and the shield machine is obtained and the total void volume is obtained by using the distance so as to be employed as a factor to be controlled. Furthermore, if the back-filling amount becomes abnormal, it can be visibly detected and therefore a proper measure can be taken.

Figure 17:
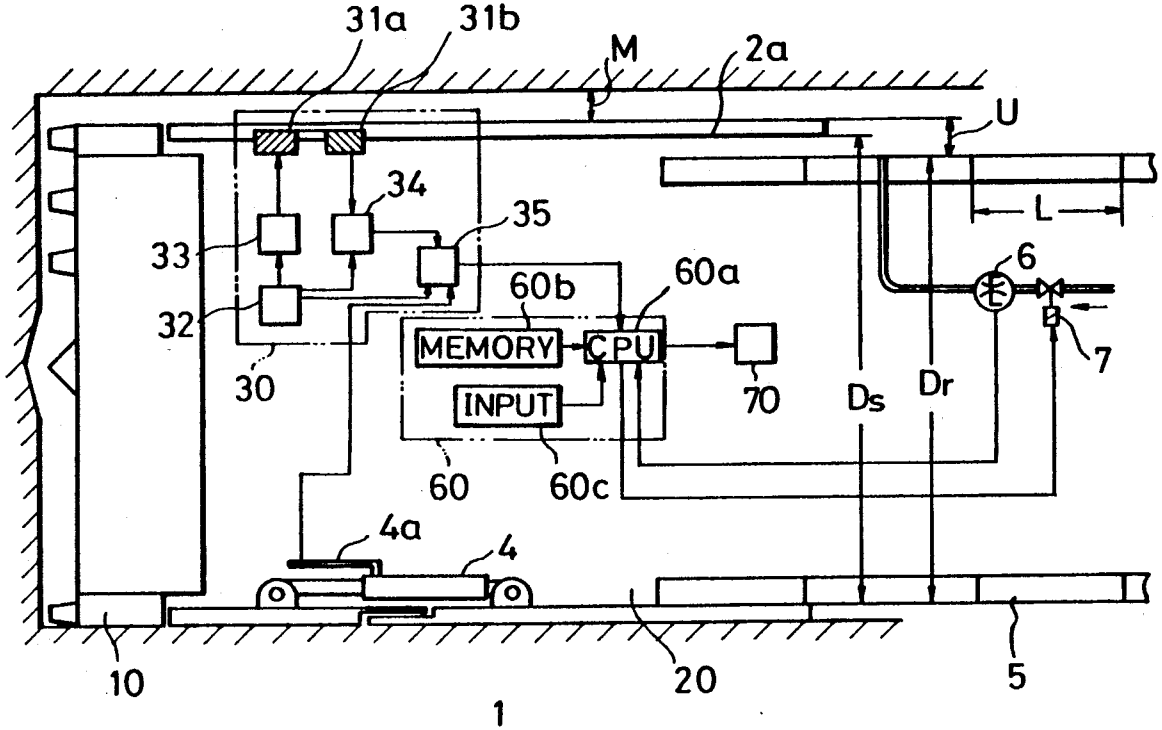
FIG. 17 is an overall structural view which illustrates a sixth embodiment of a system for calculating the back-filling amount according to the present invention.
Figure 18:
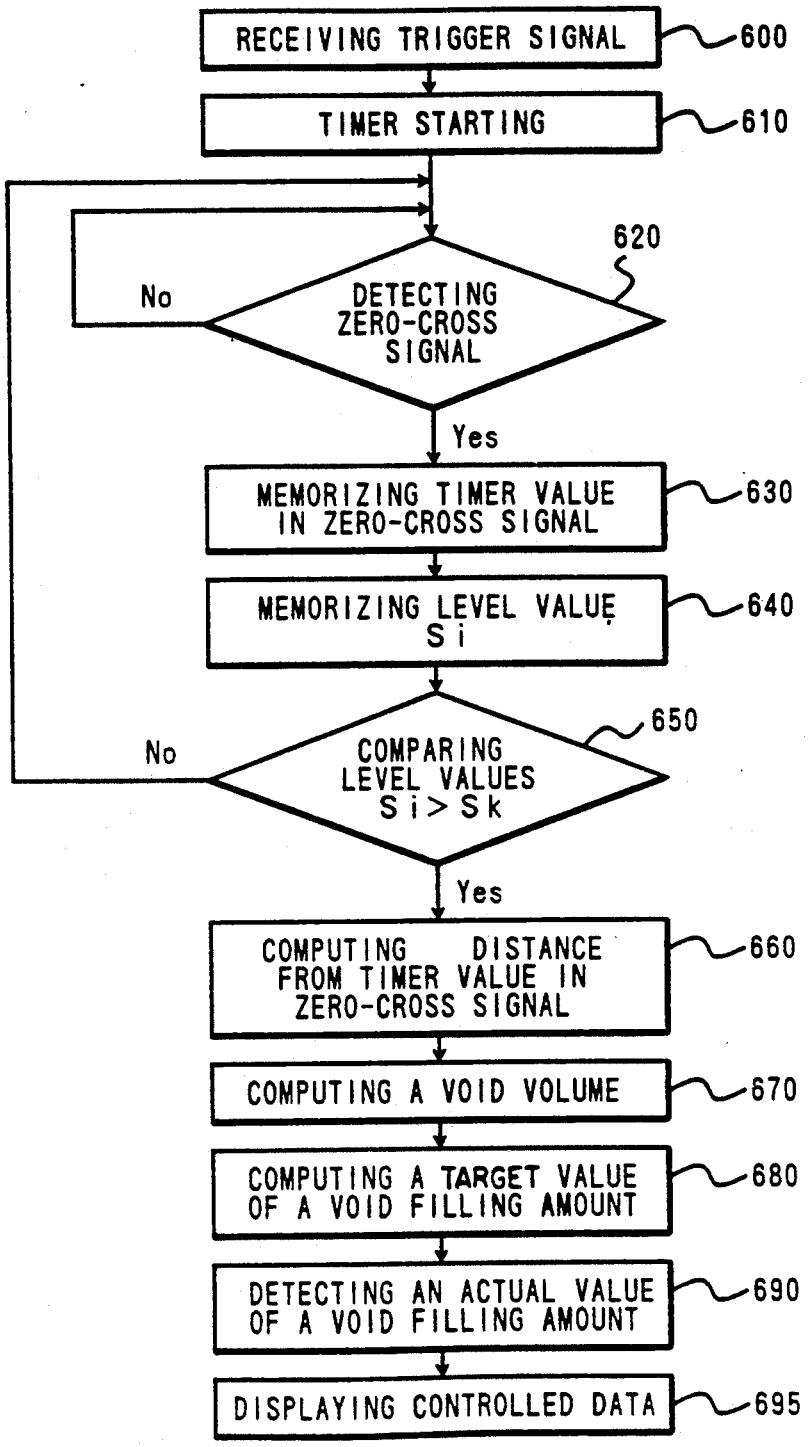
FIG. 18 is a flow chart which illustrates the operation of the system shown in FIG. 17.

Then, a sixth embodiment of a system for calculating the back-filling amount according to the present invention will now be described in detail with reference to the drawings. The same structures as those of the fifth embodiment are given the same reference numerals in the drawing and their descriptions are omitted here. FIG. 17 is an overall structural view which illustrates a sixth embodiment of a system for calculating a back-filling amount. FIG. 18 is a flow chart which illustrates the operation of the system shown in FIG. 17. The control device 60 shown in FIG. 17 is constituted by the calculating device 60*a* such as a CPU, the storage device 60*b* such as a ROM or a RAM, the input device 60*c* and an interface (omitted from illustration) so as to calculate the distance from the natural ground to the shield body 2*a* and the void volume or a target back-filling amount or the like. The driving force of the shield jack 4 and the characteristics such as the specific gravity of the soil of the natural ground are supplied from the input device 60*c* to the calculating device 60*a*. The calculating device 60*a* reads the void volume stored in the storage device 60*b* so as to set the relationship with the target back-filling amount. The calculated target back-filling amount is supplied to the display device 70 so as to be displayed. Furthermore, the position detector 4*a* is fastened to the shield jack 4 so as to detect the amount of the travel of the skin plate 2*a* and transfers the result to the control device 60 via the signal processing circuit 35. In addition, the shield body 20 has the flow meter 6 for measuring an actual back-filling amount and a stopper valve 7 so as to measure the back-filling amount Q and to transfer it to the calculating device 60*a*.

The operation of this embodiment will now be described with reference mainly to a flow chart shown in FIG. 18. Steps 600 to 670 are similar to steps 500 to 570 in the fifth embodiment shown in FIG. 13 and therefore their descriptions are omitted here.

Figure 19:
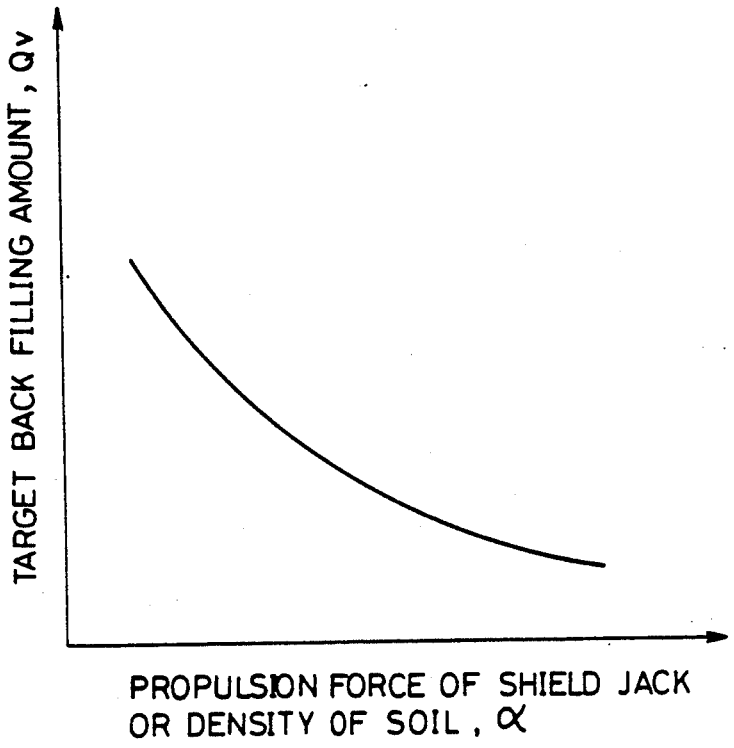
FIG. 19 illustrates the relationship between the driving force of the shield jack or the specific gravity or the like of the soil and the back-filling amount.

In step 680, target back-filling amount Qv is obtained from the volume V of the total void for one segment and the driving force of the shield jack 4 shown in FIG. 19 or the specific gravity a or the like of the soil. That is, Qv is calculated from the following equation:

$$Qv = f(\alpha)v$$

where ($\alpha$) may be, as a map, stored by the storage device 60*b*.

Figure 20:
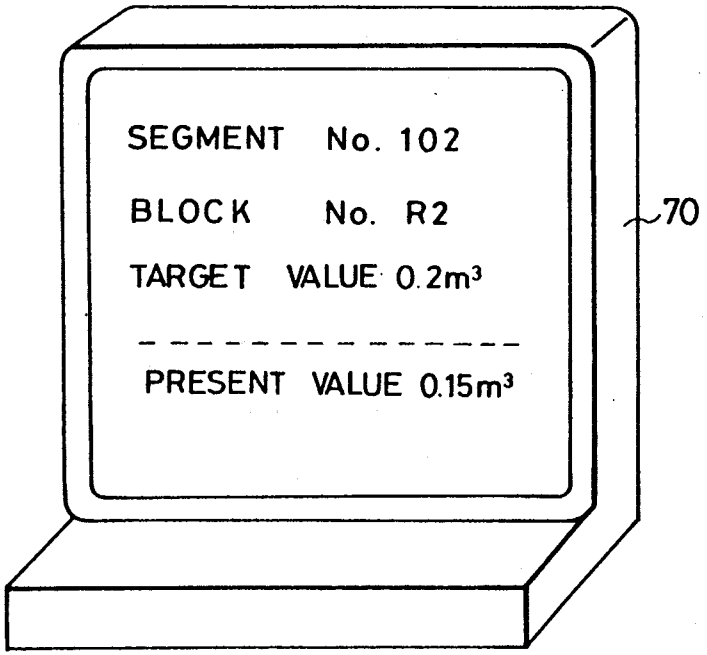
FIG. 20 illustrates the target back-filling amount and the actual filling amount.
Figure 21:
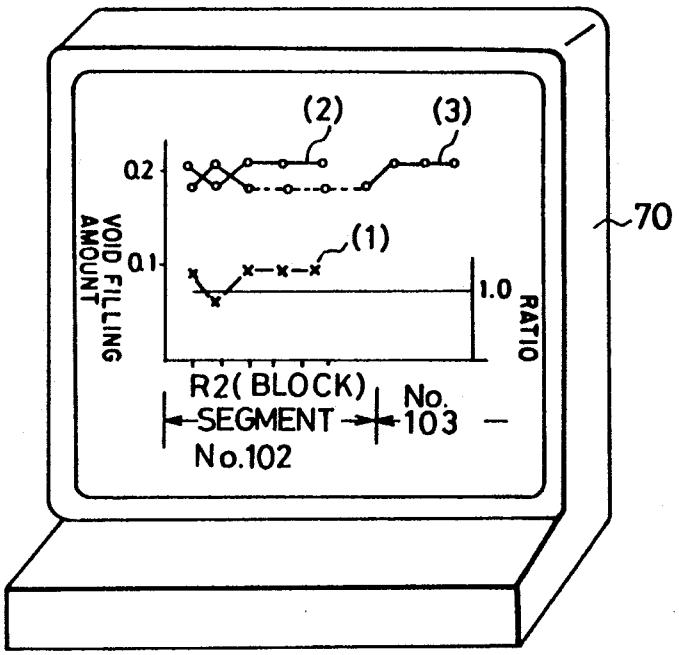
FIG. 21 is a graph which illustrates the relationship between the target backfilling amount and the actual filling amount.

In step 690, the actual back-filling amount Q is measured by the flow meter 6 and a signal denoting the measured value to the control device 60. In step 695, the result is displayed on the display device 70. FIG. 20 illustrates an example of a control table to be displayed on the display device 70, where Segment No. 102, Block No. R2, target value (the back-filling amount) 0.2 $m^3$, the present value (the present filling amount) 0.15 $m^3$ and the like are shown. As another example of the display as shown in FIG. 21 may be employed, where the segment number and the position of the block are shown on the axis of abscissa and the target back-filling amount (1), the actual back-filling amount (2) and the ratio of the actual back-filling amount (2) to the target back-filling amount (1) are shown on the axis of ordinate.

Furthermore, when the excavation proceeds to the next segment with the advancement of the excavation, the target back-filling amount (1) may be changed to (3) in the next segment in accordance with the result of the former ratio of the actual back-filling amount (2) to the target backfilling amount (1).

According to this embodiment, the back-filling work can be accurately performed because the target value of the back-filling amount is set in accordance with the characteristics of the soil by using the void volume and the comparison is performed by measuring the actual back-filling amount.

INDUSTRIAL APPLICABILITY

The present invention is advantageous when employed as a system and a method for transmitting and calculating data in a shield machine and for calculating the filling amount of a void generated outside the shield machine by detecting the distance from the shield machine to the natural ground. In particular, it is advantageous as a system and a method for transmitting and calculating data in a shield machine capable of transmitting analog signals or signals of relatively high frequencies with reliability while eliminating the influence of noise, enabling even an unskilled operator to accurately detect buried articles and accurately carry out the back-filling work.

What is claimed is:

1. A shield machine apparatus for excavating a void in a natural ground, said shield machine apparatus comprising a non-rotary shield body, a rotary cutter head rotatably mounted on the front end of said non-rotary shield body so as to excavate said void in said natural ground, transmitting/receiving antenna means positioned on one of said rotary cutter head and said non-rotary shield body for transmitting electromagnetic waves toward a portion of the natural ground defining said void and for detecting reflected waves resulting from the reflection of the thus transmitted electromagnetic waves by said portion of the natural ground and producing a reflected signal representative of the detected reflected waves, detection means for detecting either the peak value or zero cross position function of the portion of said reflected signal which is larger than a predetermined standard value; time counting means for counting the time from (a) the transmission of a trigger signal to said transmitting/receiving antenna means to cause the transmission of said electromagnetic waves, until (b) the detection of said function; and display means for displaying a function of the output of said time counting means.

2. A shield machine apparatus in accordance with claim 1 wherein said function is a peak value.

3. A shield machine apparatus in accordance with claim 2, further comprising calculating means for calculating the distance between said transmitting/receiving antenna means and said portion of the natural ground in accordance with the thus counted time; and wherein said display means displays the thus calculated distance.

4. A shield machine apparatus in accordance with claim 1 wherein said function is a zero cross position of the level value of said reflected signal which is larger than said predetermined standard value.

5. A shield machine apparatus in accordance with claim 4, further comprising calculating means for calculating the distance between said shield body and said portion of the natural ground in accordance with the thus counted time; and wherein said display means displays the thus calculated distance.

6. A shield machine apparatus in accordance with claim 4 further comprising calculating means for calculating the distance between said shield body and said portion of the natural ground in accordance with the thus counted time; forward movement measuring means for measuring the distance of the forward movement of said shield body; calculating means for calculating a void volume to be backfilled in accordance with the thus calculated distance between said shield body and said portion of the natural ground and the thus measured distance of the forward movement of said shield body; and wherein said display means displays the thus calculated void volume.

7. A shield machine apparatus in accordance with claim 6 further comprising target setting means for setting a target value of a backfilling amount in accordance with said thus calculated void volume; and wherein said display means displays said target value of said back-filling amount.

8. A shield machine apparatus in accordance with claim 7 further comprising measuring means for measuring an actual filling amount; and wherein said display means displays said actual filling amount.

9. A shield machine apparatus in accordance with claim 1 wherein said transmitting/receiving antenna means is disposed in said rotary cutter head; wherein at least one of said detection means, said time counting means, and said display means is located in said non-rotary shield body; and further comprising an electricity-to-light converter mounted in said rotary cutter head, a light-to-electricity converter mounted in said non-rotary shield body, and means for transmitting signals from said electricity-to-light converter to said light-to-electricity converter.

10. Apparatus in accordance with claim 9 wherein said transmitting/receiving antenna means is mounted in the outer portion of the front surface of said rotary cutter head.

11. Apparatus in accordance with claim 10 wherein said transmitting/receiving antenna means comprises a transmitting antenna and a receiving antenna.

12. Apparatus in accordance with claim 11 further comprising generating means for producing a signal to be transmitted by said transmitting antenna, said generating means being located in said rotary cutter head.

13. Apparatus in accordance with claim 9 wherein said means for transmitting comprises an optical rotary joint disposed between said rotary cutter head and said non-rotary shield body for transmitting light signals from said electricity-to-light converter to said light-to-electricity converter.

14. Apparatus in accordance with claim 13 wherein said optical rotary joint comprises a first optical joint portion connected to a first optical fiber on said rotary cutter head, a second optical joint portion connected to a second optical fiber on said non-rotary shield body, and means for rotatably positioning one of said first and second optical joint portions for rotation about an axis with respect to the other of said first and second optical joint portions so as to provide an optical path, the optical axis of which is the rotational axis.

15. Apparatus in accordance with claim 14, wherein said optical rotary joint further comprises a first rod lens mounted on said first optical joint portion, and a second rod lens mounted on said second optical joint portion in abutting relationship to said first rod lens, the first and second optical joint portions being disposed in such a manner that the optical axes of the first and second optical fibers and the optical axes of the first and second rod lenses coincide with each other.

16. Apparatus in accordance with claim 9 wherein said electricity-to-light converter comprises a laser signal oscillator disposed in said rotary cutter head, and wherein said means for transmitting comprises means defining a passageway between said rotary cutter head and said non-rotary body through which the laser beam can pass from said laser signal oscillator to said light-to-electricity converter.

17. A method for transmitting and calculating data in a shield machine for excavating a void in a natural ground, said shield machine having a non-rotary shield body, a rotary cutter head mounted on the front of said non-rotary shield body for excavating the void in said natural ground, and a transmitting/receiving antenna means mounted on one of said rotary cutter head and said non-rotary shield body for transmitting electromagnetic waves toward a portion of the natural ground defining said void and for detecting reflected waves resulting from the reflection of the thus transmitted electromagnetic waves by said portion of the natural ground and for producing a reflected signal which is representative of the reflected waves;

said method comprising:

detecting either the peak value or zero cross position function of the portion of said reflected signal which is larger than a predetermined standard value;

counting the time for (a) the transmission of a trigger signal to said transmitting/receiving antenna means to cause the transmission of said electromagnetic waves, until (b) the detection of said function; and displaying a function of the thus counted time.

18. A method in accordance with claim 17, further comprising calculating the distance between said transmitting/receiving antenna means and said portion of the natural ground in accordance with the thus counted time; and wherein said function of the thus counted time is the thus calculated distance.

19. A method in accordance with claim 18, wherein said function of the portion of said reflected signal is a peak value.

20. A method in accordance with claim 18, wherein said function of the portion of said reflected signal is a zero cross position of the level value of said reflected signal which is larger than said predetermined standard value.

21. A method in accordance with claim 18, wherein said function of the portion of said reflected signal is a zero cross position of the level value of said reflected signal which is larger than said predetermined standard value; and further comprising:

measuring the distance of forward movement of said shield body;

calculating a distance between said shield body and said portion of the natural ground in accordance with the thus counted time;

calculating a void volume to be back-filled in accordance with the thus calculated distance and the thus measured distance; and displaying said void volume.

22. A method in accordance with claim 21, further comprising setting a target value of the back-filling amount in accordance with said void volume;

measuring an actual back-filling amount; and displaying said target value of said back-filling amount and said actual back-filling amount.

23. A method in accordance with claim 17 wherein said transmitting/receiving antenna is disposed on the rotary cutter head; and further comprising the steps of converting, on said rotary cutter head, a signal from said transmitting/receiving antenna to an optical signal; transmitting said optical signal to said non-rotary shield body; and converting, on said non-rotary shield body, said optical signal to an electrical signal.

24. A method in accordance with claim 23 wherein said optical signal is transmitted from said rotary cutter head to said non-rotary shield body via an optical rotary joint.

25. A method in accordance with claim 23 wherein said optical signal is generated by a laser.

* * * * *

UNITED STATES PATENT AND TRADEMARK OFFICE

CERTIFICATE OF CORRECTION

PATENT NO. : 5,330,292

DATED : July 19, 1994

INVENTOR(S) : Shoichi SAKANISHI et al

It is certified that error appears in the above-indentified patent and that said Letters Patent is hereby corrected as shown below:

Column 16, line 64, change "for" to --from--.

Signed and Sealed this

Fourth Day of October, 1994

Bruce Lehman

*Attest:*

BRUCE LEHMAN

*Attesting Officer*

*Commissioner of Patents and Trademarks*